United States Patent [19]

Kidder

[11] 4,199,211

[45] Apr. 22, 1980

[54] WIRE CONNECTOR

[76] Inventor: Kent A. Kidder, 6505 Salem, Apt. 206, Lubbock, Tex. 79414

[21] Appl. No.: 970,111

[22] Filed: Dec. 18, 1978

[51] Int. Cl.[2] ..... H01R 9/06

[52] U.S. Cl. ..... 339/98; 174/84 C; 339/103 R; 339/205

[58] Field of Search ..... 339/98, 95 R, 95 D, 339/96, 97 R, 97 C, 97 P, 103 R, 205, 213 R, 248 R, 259 R, 276 R, 277 R; 174/84 C

[56] References Cited

U.S. PATENT DOCUMENTS

| | | | |
|---|---|---|---|
| 3,937,548 | 2/1976 | Dittmann | 339/95 D |
| 4,084,876 | 4/1978 | Dinger | 339/95 D |

*Primary Examiner*—Roy Lake
*Assistant Examiner*—DeWalden W. Jones

[57] ABSTRACT

A connector for one or more wires includes a casing, a cavity within the casing, an opening in the casing providing a path leading into the cavity for the insertion of a wire, a wire gripping member secured to one side of the casing within the cavity for automatically engaging a wire inserted into the cavity through the opening. The wire gripping member is normally inwardly inclined away from the cavity opening across the path of a wire being inserted through the opening, and is resiliently yieldable to swing toward and away from the opening across the path of the inserted wire. The gripping member has a free end and a secured end about which the gripping member swings. A V-shaped slot having converging sharp edge portions for cutting the insulation of an insulated wire extends inwardly from the free end of the gripping member. A narrow slot having blunt edges for gripping the bare wire forms an extension of the V-shaped slot toward the secured end of the gripping member and terminates short thereof. A cam surface terminating in a ridge inward of the gripping member projects across the cavity opposite the gripping member for forcing a wire into the V-shaped slot as the wire is inserted into the cavity. An outward tug upon the wire after it is inserted into the cavity against the cam surface and into engagement with the gripping member swings the gripping member toward the opposite side of the cavity from the secured end. The cam surface cooperating with the transversely swinging gripping member forces the wire into the narrow gripping slot of the gripping member where the wire is securely held. A lock is provided within the casing to hold the gripping member in a position extending transversely of the cavity.

24 Claims, 12 Drawing Figures

WIRE CONNECTOR

BACKGROUND OF THE INVENTION

1. Field of the Invention

This invention relates to an improved wire connector and particularly to a connector for quickly and easily connecting insulated electrical wires as well as other types of wires of more general utility without the use of any tools.

2. Description of the Prior Art

Various connectors have been developed in the past for quickly connecting one or more wires to the connector upon the insertion of a wire into a cavity provided in the connector where the wire is gripped by gripping means provided in the cavity. Patents representative of the prior art relating to connectors of the aforesaid type include the following U.S. Pat. Nos.:

Re.26,994
2,291,434
2,370,725
2,816,193
3,093,433

Each of the above patents disclose a connector which includes a cavity within the connector, an opening leading into the cavity and a wire gripping member secured within the cavity for engaging a wire inserted into the cavity through the opening. The wire gripping member is bendably secured to the connector inside the cavity and is normally inclined inwardly away from the opening into the cavity across the path of a wire being inserted through the opening into the cavity. The gripping member upon being struck by the inserted wire yieldably bends away from the path of the wire and as a result of its resiliency the gripping member maintains contact with the wire. Usually the gripping member has a sharp point or free edge which bites into the surface of the inserted wire upon an outward tug being applied to the wire after its insertion into the connector cavity.

The connectors disclosed in U.S. Pat. Nos. 2,370,725 and 3,093,433 include gripping means which in addition to biting into the surface of the wire, crimp the wire upon the application of an outward tug upon the wire.

The present invention distinguished from the connectors disclosed in the aforesaid patents particularly with respect to the structure of the wire gripping member provided in the connector and with respect to means provided in the cavity of the connector for forcing an inserted wire into contact with the gripping means. The gripping member of the present invention includes a wedge-shaped slot having converging sharp edge portions for cutting the insulation surrounding an insulated wire and parallel blunt edge portions for gripping the wire after the insulation has been cut. The connector of this invention further includes cam means spaced inwardly from the gripping means relative to the opening in the connector for forcing a wire inserted into the connector cavity against the sharp edge of the wedge-shaped slot of the gripping means.

U.S. Pat. No. 2,816,193 discloses a wire gripping means having a wedge-shaped slot, however, it has no cam means for forcing the wire into the wedge-shaped slot of the gripping member.

Electrical connectors which have contact members provided with wedge-shaped slots into which electrical wires are forced are further disclosed by the following representative U.S. Pat. Nos.:

2,501,187
2,694,189
3,012,219
3,058,088
3,234,498
3,612,747
3,950,062

Except for having slotted wire contact members, the connectors disclosed by the latter group of patents listed above are quite distinct from the present invention, and they require substantially different manipulative steps inorder to make the wire connection.

SUMMARY OF THE INVENTION

It is therefore an object of this invention to provide an improved wire connector to which one or more wires may be quickly and easily connected without the use of tools.

It is a further object of this invention to provide a wire connector which has improved wire gripping means for automatically gripping a wire inserted into the connector upon the application of an outward tug upon the connector.

It is a further object of this invention to provide a wire connector which has an improved gripping means having a wire gripping slot and cam means cooperating with the wire gripping slot to force a wire into the wire gripping slot upon the insertion of a wire into the connector and the application of an outward tug upon the wire.

It is still another object of the invention to provide locking means within the connector to lock the wire gripping means in fixed position within the connector after a wire has been forced into a wire gripping slot of the gripping means.

In its preferred form, the connector of this invention comprises a tubular casing member of conductive metal having opposite open ends for the insertion of wires into the casing. A wire gripping member is bendably secured to one side of the tubular casing member inwardly of each open end and is inclined inwardly and away from the respective open ends. Cam surface means project from the side of the casing opposite the side to which the gripping members are secured for forcing a wire inserted into the tubular casing member against the free end of the gripping members. Each of the gripping members has a V-shaped slot extending inwardly from the free end thereof, and a narrow wire gripping slot extending from the V-shaped slot toward the secured end of the gripping member but terminating short thereof. The V-shaped slot has sharp converging edges for cutting wire insulation and the narrow slot has blunt edges for gripping the bare wire from which the insulation has been cut by the sharp edges of the V-shaped slot. The gripping member spaced inwardly of each open end of the casing is resiliently yieldable to swing toward and away from a respective open end across the casing but its swinging movement toward the open end is limited by the engagement of the free end of the gripping member with the casing wall opposite the side of the casing to which the gripping member is secured. The length of the gripping member is slightly longer than the shortest distance from the secured end of the gripping member across the casing.

Various locking means such as grooves in the wall of the connector casing for engaging the free end of the gripping members and detent tabs struct out of the wall of the casing for engaging behind the gripping member can be provided to lock the gripping member in a fixed position.

Although the connector of this invention has special utility for connecting electrical conductors, it also has general utility for the connection of other type of wires.

BRIEF DESCRIPTION OF THE DRAWINGS

With the foregoing more important objects and features in view and such other objects and features which may become apparent as this specification proceeds, the invention will be understood from the following description taken in conjunction with the accompanying drawings, in which like characters of reference are used to designate like parts, and in which.

DETAILED DESCRIPTION

Figure 1:
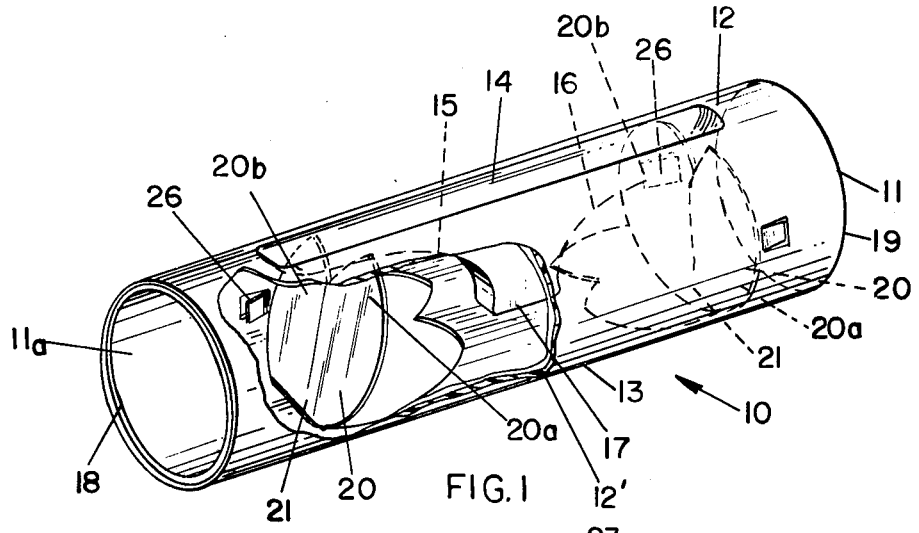
FIG. 1 is a perspective view of one embodiment of the invention with a side wall portion broken away to show the interior of the connector.
Figure 2:
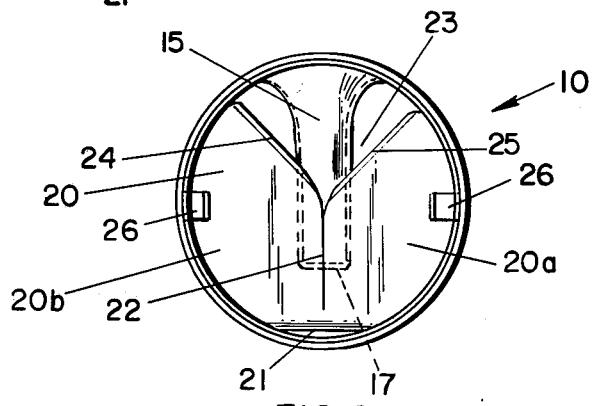
FIG. 2 is an end view of the connector shown in FIG. 1.

Referring to the drawings and particularly to FIG. 1, a wire connector in accordance with the present invention is generally indicated by the reference numeral 10. The connector 10 comprises a tubular metal casing 11 covered by a sheath 12' of electrical insulation. The casing 11 is hollow providing an elongated cavity 11*a*, and it has open ends 18 and 19 providing coaxial paths leading into the cavity for the insertion of a pair of wires. A wire gripping member 20 is secured to one side 13 of the casing 11 inwardly from each of the open ends 18 and 19 for automatically engaging wires inserted into the cavity through the open ends. Each of the wire gripping members 20 is normally inclined inwardly from one of the open ends 18 and 19 and extends across the path of wire insertion through the one open end from which the gripping member is inclined.

The gripping members 20 are each integral metal arms which are struck out of the side of the casing 11 and bent inwardly into the casing about a hinge line 21. They are each resiliently yieldable to swing toward and away from the open end to which each is normally inclined across the path of a wire being inserted through the open end. Each gripping member 20 is a substantially flat plate having a perimeter which conforms generally to an interior transverse cross sectional configuration within the casing 11 but somewhat smaller inorder that the member 20 may swing freely in a limited arc within the casing 11 about the hinge line 21. The hinge line 21 forms a secured end for each gripping member 20 connecting the gripping member to the casing 11. Each gripping member 20 has a free end opposite the secured end 21 in which a V-shaped slot 23 is cut. The V-shaped slot 23 extends inwardly from the free end of the gripping member and is defined by inwardly converging sharp edge portions 24 and 25 for cutting through the insulation of an insulated wire. A narrow slot or slit 22 having blunt edges for gripping the bare wire from which insulation has been cut by the edges 24 and 25, forms an extension of the V-shaped slot 23 toward the secured end 21 of the gripping member and terminates short thereof. The slot 23 and slit 22 split the gripping member 20 into two portions 20*a* and 20*b*. The length of the split portion 20*a* measured from the hinge line 21 to its free end tip 20*a*' is somewhat shorter than the length of the split portion 20*b* measured from the hinge line 21 to its free end tip 20*b*'. The length of split portions 20*a* and 20*b* are selected so that the portions will strike the inside wall of the casing 11 at longitudinally spaced points opposite the hinge line 21 thus limiting the upward swing of the portions 20*a* and 20*b* and permitting them to spread apart in a longitudinal direction for a purpose which will be subsequently described.

The side 12 of the casing opposite the side 13 to which the gripping members 20 are secured is depressed inwardly at 14 by suitable deforming means to provide cam surfaces 15 and 16 on opposite sides of a ridge 17 located centrally between the two gripping members 20,20. The ridge 17 extends from side 12 past the longitudinal axis of the casing 11 toward the opposite side 13 but is spaced from the side 13. The cam surfaces 15 and 16 extend longitudinally from the ridge 17 in opposite directions toward the open ends 18 and 19 respectively. The surfaces 15 and 16 are generally curved in a longitudinal direction from areas outwardly of the areas where the opposite gripping members 20,20 contact the casing side 13 opposite the side 12 toward the ridge 17. The V-shaped slot 23 of the gripping members 20,20 permits each of the gripping members to span one of the surfaces 15 and 16 as the gripping members swing about their hinge lines 21.

Locking tabs 26 are cut in the casing walls and pushed inwardly to engage behind the gripping members 20,20 after the gripping members have been swung away from the casing side 13 until their movement is stopped by engagement of the gripping members with the casing wall opposite side 13. The tabs prevent retrograde movement of the gripping members toward the side 12.

Figure 3:
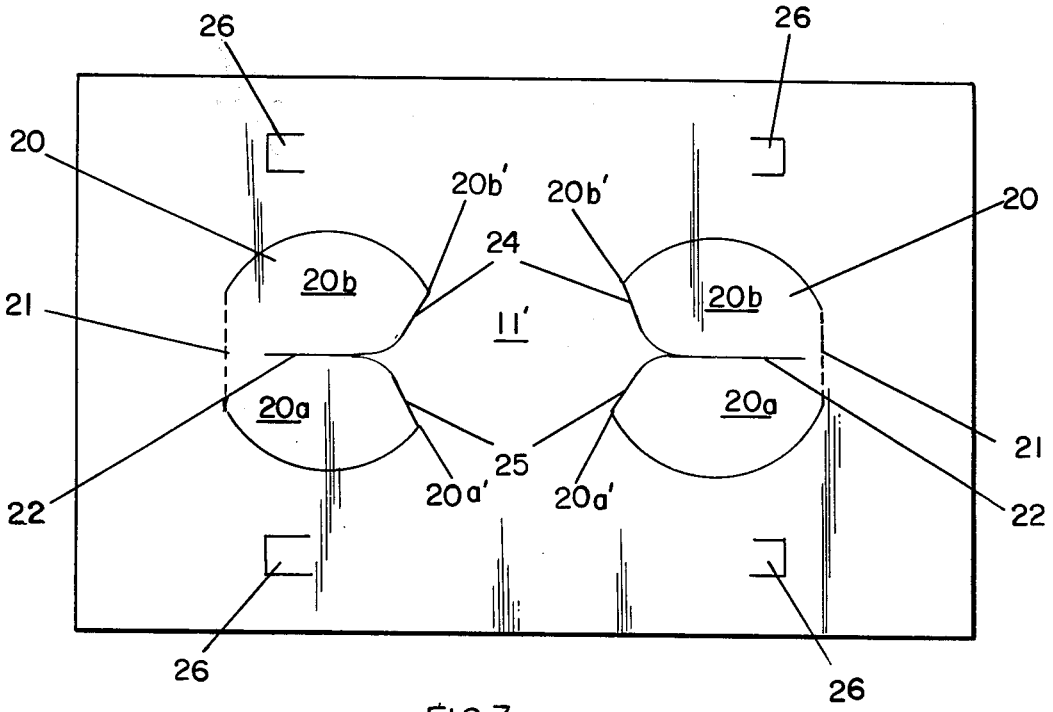
FIG. 3 is a top plan view of a stamped metal blank from which the connector shown in FIG. 1 is formed.
Figure 4:
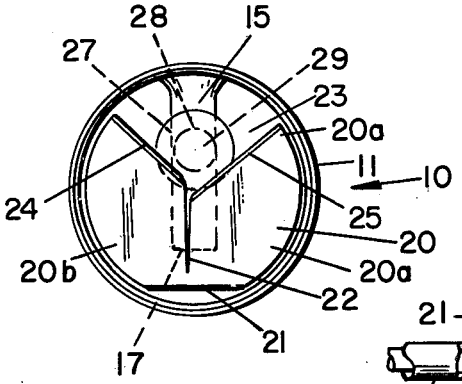
FIG. 4 is an end view of the connector shown in FIG. 1 showing an insulated wire in phantom after it has been inserted into the connector.
Figure 5:
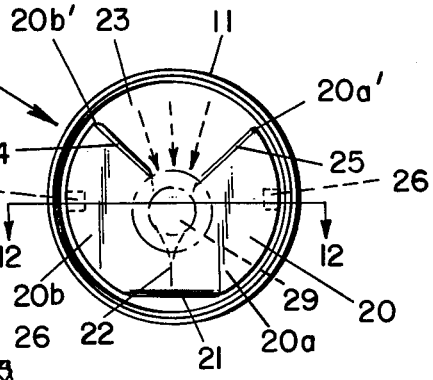
FIG. 5 is an end view similar to FIG. 4 but showing an insulated wire in phantom after it has been forced down into the gripping slot of the gripping member of the connector.

FIG. 3 shows a flat generally rectangular blank 11' of metal such as copper, from which the casing 11 is formed. The gripping elements 20,20 and the four locking tabs 26 are cut in the blank 11' by a suitable stamping die. The tubular casing 11 shown in FIG. 1 is formed by bending and securing the blank 11' into tubular shape and depressing the gripping elements 20,20 and locking tabs 26 inwardly into the casing. The cam surfaces 15 and 16 within the deformed area 14 are depressed inwardly subsequent to forming the blank 11' into the tubular shape shown in FIG. 1.

Now looking at FIGS. 4–7, the operation of connecting an insulated wire 27 to the connector 10 will be described. Although the following description only describes the connection of one wire, it will be understood that the connection of a second wire will be made in the same manner. In making the connection, a wire 27 is inserted into the connector 10 through the open end 18 and is pushed forward over the gripping member 20 through the V-slot 23. As the wire 27 moves over the gripping member 20, its leading end is forced downwardly by the cam surface 15. This forces the wire 27 down against the sharp cutting edges 24 and 25 of the gripping member 20. The elasticity of the metal from which the casing 11 and gripping members 20 are formed, such as half-hard copper, will present a constant, although slight, resistance to the insertion of the wire 20 and in so doing, will keep a constant pressure-contact between the wire and the knife edges 24 and 25.

Figure 12:
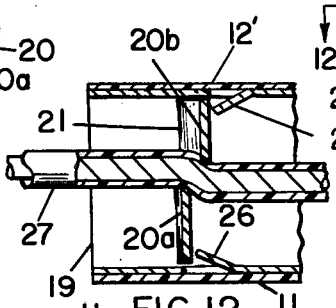
FIG. 12 is a longitudinal horizontal cross-sectional view taken on line 12—12 of FIG. 5.
Figure 6:
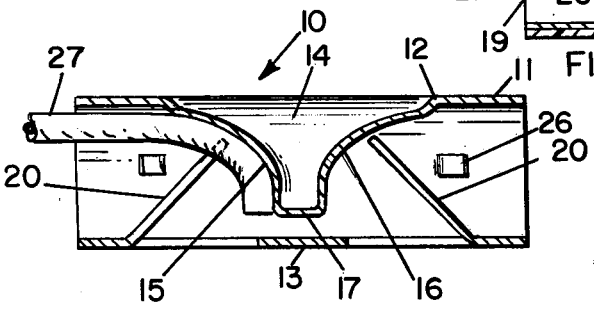
FIG. 6 is a longitudinal sectional view of the connector of FIG. 1 with a conductor inserted into the connector.
Figure 7:
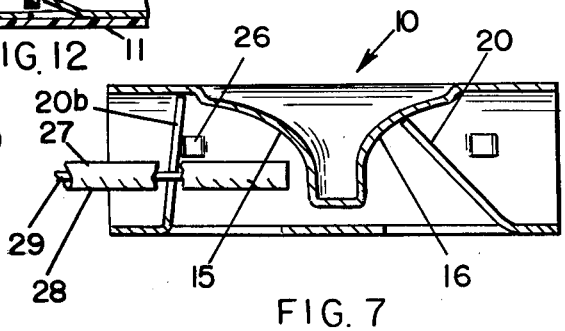
FIG. 7 is a longitudinal sectional view similar to FIG. 6 but showing a conductor held by the gripping member after it has been rearwardly retracted to force the wire into the wire gripping slot of the gripping member.

After the wire is inserted, the user of the connector 10 will tug the wire, as if to withdraw it from the connector, and in so doing will begin the process which will cause the knife edges 24 and 25 to cut through the insulation surrounding the conductor 29. At the same time, the pulling will cause the gripping member 20 to swing to an upright position. During the process of cutting the insulation 28 and moving the gripping member 20 upright, the insulation 28 will be cut through leaving the conductor 29 bare. Since the cross-sectional area within the casing 11, which the gripping member 20 is closing off as it is swung upright is greatly decreased, the wire 20, which is now bared, will be forced into the slot 22. As the gripping member 20 is swung upright, one of the split portions **20*a* of the gripping member 20 separated by the slots 22 and 23 which is slightly shorter than the other portion 20*b* will swing upright further than the longer portion. The slot 22 is extremely narrow and not wide enough for even the stripped conductor 29 to be wedged into, but since one side of the gripping member 20 does not travel as far as the other side, the wire 29 can bend around behind the first split portion 20*a* and on past the second split portion 20*b*. Thus, the resulting effect will be for the wire to be wedged between the two sides of the gripping member 20 and to also be bent behind one of them. This is shown in FIG. 12**.

The cross-sectional area of the casing 11 which the nearly upright gripping member or arm 20 occupies will be too small to allow the arm to reach a completely upright position, so the arm 20 and the wire 27 will be prevented from being pulled any further toward the end 18 of the casing 11. At a point just slightly before the gripping member's motion is completely retarded, the gripping member 20 will move past the slightly elastic and small locking tabs 26 which are cut from the casing wall in such a way that they can be sprung back from the path of the gripping member by the force of the gripping member against it. Once the gripping member has past, the tabs 26 will recoil behind the gripping member 20 to prevent it from being pushed back toward the center of the tube.

The cam surface 15 which projects inwardly from the side 12 toward the center of the casing 11, also extends longitudinally through the V-shaped slot 23 when the gripping member 20 is in its locked nearly upright position. The cam surface 15 will hold the wire 27 down inside the slot 23.

Figure 8:
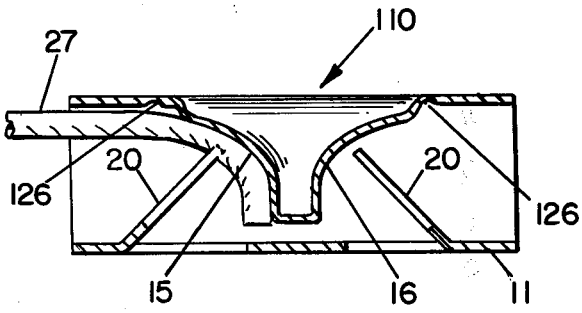
FIG. 8 is a longitudinal sectional view similar to FIG. 6 of another embodiment of the connector showing a wire after insertion into the connector.
Figure 9:
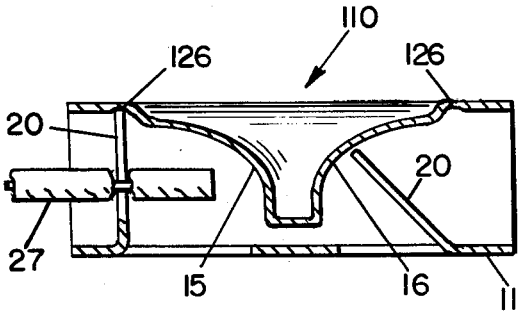
FIG. 9 is a view similar to FIG. 8 showing a wire after its insertion into the connector and after the application of an outward tug upon the wire to swing the wire gripping element upright across the cavity of the connector and into a locked position.

In FIGS. 8 and 9, a slightly modified connector embodiment 110 is shown. The connector 110 is similar in all respects to the connector 10 with the exception that instead of having locking tabs 26 which engage behind the gripping members 20, the connector 110 has locking grooves 126 formed in the inside wall of the connector into which the free ends of the gripping members snap when the gripping members 20 are swung to a nearly upright position. FIG. 8 shows the connector 110 after a wire 27 has been inserted into one end of the connector. FIG. 9 shows the same connector 110 after an outward tug has been applied to the wire 27 swinging the gripping member 20 nearly upright and the free end of gripping member 20 is engaged in the locking groove 126.

Figure 10:
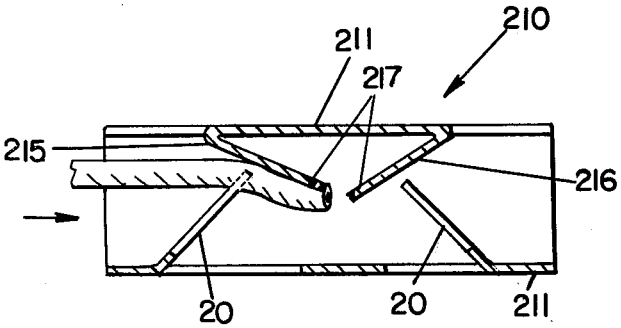
FIG. 10 is a longitudinal sectional view of still another embodiment of the invention showing a wire inserted in the connector.
Figure 11:
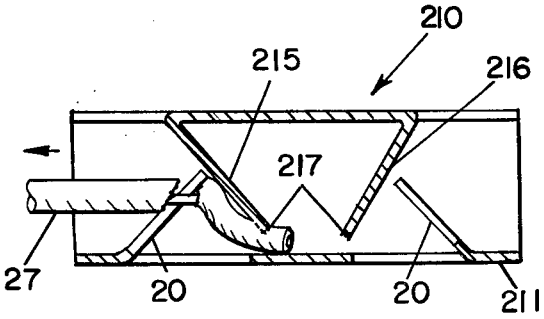
FIG. 11 is a view similar to FIG. 10 but showing the connector and wire held by the wire gripping member of the connector after an outward tug has been applied to the wire to force the wire into the gripping slot of the gripping member.

FIGS. 10 and 11 show still another modified connector embodiment 210. The connector 210 includes a tubular casing 211 generally similar to the tubular casing 11 of the connector embodiment 10 previously described. A pair of gripping members 20 similar to the gripping members 20 of the connector 10 are struck out of the casing wall 211 and bent inwardly to the inclined position shown about hinge lines 21,21. Instead of the cam surfaces 15 and 16 provided in the connectors 10 and 110 by forming a depression in the wall opposite the wall area to which the gripping members 20,20 are secured, the connector 210 has a pair of inwardly inclined arms 215 and 216 which are struck out of the wall of casing 211 opposite to the gripping elements 20,20. The arms 215 and 216 are reversely bent with respect to the gripping elements 20,20. The free ends 217 of the arms 215 and 216 are toothed in order to bite into the surface of a wire inserted into the connector. The arms 215 and 216 provide cam surfaces for forcing a wire against the sharp edges of the V-shaped slot formed in gripping members 20.

FIG. 10 shows a wire 27 inserted into the connector 211 over the gripping member 20 and under the arm 215. FIG. 11 shows the wire 27 after an outward tug has been applied to the wire causing the teeth of the arm 215 to bite through the insulation of the wire 27. As the wire 27 is pulled outward, the arm 215 with its teeth biting into the wire swings down toward the side of casing 211 where the gripping member 20 is hinged. The downward motion of the arm 215 forces the wire 27 down into the slot 22 of the gripping member 20. At the same time that the arm 215 is being swung down, the gripping member 20 is being swung up, thus the movements of the arm 215 and of the gripping member 20 cooperate to force the wire 27 securely into the gripping slot 22 of the gripping element 20.

Although not shown, the connector 210 may have locking means such as the locking tabs 26 of connector 10 and the locking groove 126 of connector 110 for locking the gripping element 20 in a nearly upright position.

In the connectors disclosed herein, it is within the scope of this invention that petroleum jelly or other suitable potting material (not shown) be used to fill the connector after the wire, or wires, are connected to the connector in the manner disclosed herein.

A particular economic advantage of the present connector is that it can be manufactured from a single blank or cylinder of metal and consequently at less cost than multi-piece connectors. No plastic molding is required because the insulation sheath 12' can be extruded around the completed connector.

The invention has been described in detail for the purpose of illustration, but it will be obvious that numerous modifications and variations may be resorted to within the spirit and scope of the invention without departing from the claims.

What is claimed is:

1. A wire connector comprising a tubular member having at least one open end for the insertion of a wire, a wire gripping member secured in said tubular member and inclined inwardly and away from said one open end, said wire gripping member having one end resiliently secured to said tubular member and a free end opposite said second end, a slot formed in said gripping member and extending from said free end toward said secured end, said slot being wide at said free end and narrowing toward said secured end, cam means projecting inwardly from said tubular member and spaced longitudinally inwardly of said gripping member from said one open end for forcing a wire which is inserted into said connector through said one open end and over said inclined gripping member down into said slot where an outward pull upon said wire causes the gripping member to be forced nearly upright in said tubular member and causes the wire to be forced downwardly into said slot.

2. The wire connector of claim 1 together with locking means in said tubular member for locking said gripping means nearly upright in said tubular member.

3. The wire connector of claim 2 wherein said locking means comprises resilient cam detent means projecting inwardly from said tubular member in a position to move outwardly as the gripping member is swung nearly upright allowing said gripping member to pass and to spring inwardly behind said gripping member when said gripping member is in the nearly upright position.

4. The wire connector of claim 2 wherein said locking means comprises a groove formed in said tubular member transversely opposite said secured end of said gripping member, said gripping member being of a length approximately equal to the distance between said secured end and the bottom of said groove so that when said gripping member is swung nearly upright the free end of said gripping member becomes seated in said groove.

5. The wire connector of claim 1 wherein said slot in said gripping member comprises a V-shaped notch portion extending inwardly from said free end to an apex intermediate said free end and said secured end, and a slit extending from said apex toward said secured end and terminating short of said secured end, said slot dividing said gripping member into portions of unequal length.

6. The wire connector of claim 1 wherein said tubular member is made of electrically conductive metal and provides an electrical connector for an electrical conductor.

7. The wire connector of claim 1 together with a sheath of electrical insulation covering said tubular member.

8. The electrical connector of claim 1 wherein said tubular member has a pair of coaxially open ends, there being one of said wire gripping members transversely inclined inwardly from each of said open ends, and cam means longitudinally spaced inwardly from each of said wire gripping members.

9. A wire connector comprising a casing having a cavity therein, an opening in the casing providing a path leading into the cavity for the insertion of a wire, wire gripping means secured inside the cavity for automatically engaging a wire inserted into the cavity through the opening, said wire gripping means being normally inclined away from said opening and being resiliently yieldable to swing toward and away from said opening across the path of a wire being inserted through said opening, said gripping means being a thin plate-like gripping member having a free end and a secured end opposite said free end about which said gripping member swings, slot means formed in said gripping member for receiving and gripping a wire inserted into said cavity through said opening, surface means within said casing opposite said gripping means for forcing a wire into said slot means as the wire is inserted into said cavity, said gripping means being cooperative with said surface means to force a wire further into said slot means where the wire is tightly gripped upon an outward tug being applied to the wire to cause said gripping means to swing toward said opening.

10. The wire connector of claim 9 wherein said slot means comprises a V-shaped slot having converging edge portions extending inwardly from said free end of said gripping means and a narrow slot extending inwardly from said V-shaped slot toward said secured end, said slot means splitting said plate-like gripping member into two gripping portions.

11. The wire connector of claim 10 wherein said converging edge portions of said V-shaped slot are sharp cutting edges for cutting the insulation of an insulated electric wire and said narrow slot has blunt edges for gripping a wire bared by said cutting edges.

12. The wire connector of claim 10 wherein said narrow slot is a slit which has a width less than the diameter of the wire to be connected by said connector, and wherein said two gripping portions are capable of spreading apart out of the normal plane of said gripping member whereby a wire entering said slit is caused to bend behind one of said gripping portions.

13. The wire connector of claim 12 wherein one of said gripping portions is slightly longer than the other gripping portion so that the shorter gripping portion is permitted to swing further toward said opening than the longer gripping portion within the confines of said cavity.

14. The wire connector of claim 9 wherein said surface means for forcing a wire into said slot means includes a cam surface projecting inwardly from the side of said casing opposite said wire gripping means.

15. The wire connector of claim 14 wherein said cam surface comprises an arm inclined inwardly from said opening across the path leading into said cavity for the insertion of a wire, said arm having one end bendably secured to said casing for swinging toward and away from opening, and a free end opposite said bendably secured end having means thereon for biting into the surface of a wire.

16. The wire connector of claim 14 wherein said cam surface is an inwardly depressed portion of said casing.

17. The wire connector of claim 16 wherein said inwardly depressed portion of said casing extends longitudinally from an area outwardly of the position where said gripping member becomes nearly upright to an area inwardly of said gripping means in its normally inclined position, said depressed portion becoming increasingly depressed as it extends inwardly.

18. The wire connector of claim 9 wherein said plate-like gripping member has peripheral edge portions, and said cavity has interior surface confining means which closely confine the peripheral edge portions of said plate-like gripping member and limit the swinging movement of said gripping member toward said opening.

19. The wire connector of claim 18 together with automatic holding means within said casing for holding said gripping member against substantial return movement once it has been swung toward said opening to the limit permitted by said interior surface means.

20. The wire connector of claim 9 wherein said casing is an elongated metal tube and said cavity extends longitudinally therethrough, said plate-like gripping member being die struck out of said tube and bent inwardly to said normal inclination about a bend line integral with said casing.

21. The wire connector of claim 20 wherein said metal tube is made of electrically conductive metal to provide an electrical connector, together with electrical insulation means covering said metal tube.

22. A wire connector for connecting a pair of aligned wires comprising an elongated metal tube having opposite open ends, each open end providing a path for the insertion of one of the pair of wires into the metal tube, a pair of wire gripping means secured in said tube inwardly of each of said open ends for automatically engaging the wires inserted through said open ends, one of said wire gripping means of said pair being normally inclined away from one of said open ends and the other of said wire gripping means of said pair being normally inclined away from said other open end, both wire gripping means being secured on the same side of said metal tube and each being resiliently yieldable to swing toward and away from the respective open end from which it is inclined across the path of insertion of a wire into the tube through the respective open end, each of said gripping means being a thin plate-like gripping member having a free end and a secured end opposite said free end about which said gripping member swings, slot means formed in each gripping member for receiving and gripping a wire inserted into said tube through the open end from which the respective gripping means is inclined, surface means within said casing opposite each of said gripping means for forcing wires which are inserted into the tube through said open ends into said slot means as the wires are pushed inwardly toward the center of the tube, each of said gripping means being cooperative with said surface means to force a wire further into said slot means where the wire is tightly gripped upon an outward tug being applied to the wire to cause said gripping means to swing toward said opening.

23. The wire connector of claim 22 wherein each of said plate-like gripping members is cut out of the wall of said tube and is bent into said tube about a bend line formed in said tube.

24. The wire connector of claim 23 wherein said metal tube is made of electrically conductive metal to provide a connector for electric wires, together with electric insulation means covering said tube.

* * * * *